US009546476B2

(12) United States Patent
Lee et al.

(10) Patent No.: US 9,546,476 B2
(45) Date of Patent: Jan. 17, 2017

(54) TOILET CLEANING APPARATUS HAVING BUBBLE SUPPLY MECHANISM AND CLEANING METHOD OF TOILET CLEANING APPARATUS

(71) Applicant: COWAY CO., LTD, Chungcheong-nam-do (KR)

(72) Inventors: Sung-Hee Lee, Seoul (KR); Hyun-Kang Lee, Seoul (KR)

(73) Assignee: COWAY CO., LTD., Chungcheong-nam-do (KR)

( * ) Notice: Subject to any disclaimer, the term of this patent is extended or adjusted under 35 U.S.C. 154(b) by 187 days.

(21) Appl. No.: 14/384,417

(22) PCT Filed: Jan. 21, 2013

(86) PCT No.: PCT/KR2013/000469

§ 371 (c)(1),
(2) Date: Sep. 11, 2014

(87) PCT Pub. No.: WO2013/147408

PCT Pub. Date: Oct. 3, 2013

(65) Prior Publication Data

US 2015/0101113 A1 Apr. 16, 2015

(30) Foreign Application Priority Data

Mar. 28, 2012 (KR) ..... 10-2012-0031685
Oct. 18, 2012 (KR) ..... 10-2012-0116200

(51) Int. Cl.
*E03D 9/00* (2006.01)

(52) U.S. Cl.
CPC ..... *E03D 9/005* (2013.01)

(58) Field of Classification Search
CPC ..... E03D 9/005; E03D 2009/028
See application file for complete search history.

(56) References Cited

U.S. PATENT DOCUMENTS 5,536,368 A * 7/1996 Makela ..... B01F 3/04468 162/52
7,316,038 B2 * 1/2008 Egeresi ..... A47K 13/30 4/223

(Continued)

FOREIGN PATENT DOCUMENTS

CN 201381543 Y 1/2010
CN 101839016 A 9/2010

(Continued)

OTHER PUBLICATIONS

State Intellectual Property Office of the People's Republic of China for Application Patent No. 201380015144.8—First Office Action, Dated Jun. 9, 2015, with Englis translation.

(Continued)

*Primary Examiner* — Janie Loeppke
(74) *Attorney, Agent, or Firm* — Dority & Manning, P.A.

(57) ABSTRACT

There are provided a toilet cleaning apparatus having a bubble supply mechanism and a cleaning method thereof. The toilet cleaning apparatus having a bubble supply mechanism includes a mixture tank in which raw water supplied from a raw water supply unit, air introduced from an air supply unit, and a cleaning solution supplied from a cleaning solution supply unit are mixed and accommodated, a bubble generation unit provided in the mixture tank and generating bubbles with the raw water, air, and the cleaning solution by using an impeller, and a bubble discharging unit connected to the mixture tank and discharging bubbles generated by the bubble generation unit to the toilet bowl to cover water stored in the toilet.

18 Claims, 9 Drawing Sheets

(56) References Cited

U.S. PATENT DOCUMENTS

| | | | | |
|---|---|---|---|---|
| 2007/0234470 | A1* | 10/2007 | Sawalski | B65D 83/20 4/223 |
| 2011/0241230 | A1* | 10/2011 | Kerfoot | B01D 17/0205 261/37 |

FOREIGN PATENT DOCUMENTS

| | | | |
|---|---|---|---|
| CN | 101886423 | A | 11/2010 |
| CN | 201794137 | U | 4/2011 |
| JP | 2007-284999 | | 11/2007 |
| JP | 2007-314957 | | 12/2007 |
| JP | 2008-291521 | | 12/2008 |
| JP | 2009-007930 | | 1/2009 |
| KR | 2007-0063626 | | 6/2007 |
| KR | 2008-0093532 | | 10/2008 |

OTHER PUBLICATIONS

Written Opinion of The International Searching Authority PCT/KR2013/000469 (4 Pages) Dated: Apr. 26, 2013.
International Search Report PCT/KR2013/000469 (2 Pages) Dated: Apr. 29, 2013.

* cited by examiner

TOILET CLEANING APPARATUS HAVING BUBBLE SUPPLY MECHANISM AND CLEANING METHOD OF TOILET CLEANING APPARATUS

CROSS REFERENCE TO RELATED APPLICATIONS

This application is the U.S. National Stage entry of International Application Number PCT/KR2013/000469, filed under the Patent Cooperation Treaty having a filing date of Jan. 21, 2013, which claims priority to Korean Patent Application Serial Number 10-2012-0031685, having a filing date of Mar. 28, 2012, and Korean Patent Application Serial Number 10-2012-0116200 having a filing date of Oct. 18, 2012.

TECHNICAL FIELD

The present invention relates to a toilet cleaning apparatus having a bubble supply mechanism and a cleaning method thereof, and more particularly, to a toilet cleaning apparatus having a bubble supply mechanism capable of preventing odor within a toilet and maintaining a clean nozzle, and a cleaning method thereof.

BACKGROUND ART

In general, a toilet (i.e., a toilet bowl, a chamber pot, etc.) is a piece of equipment allowing a user to be seated to pass a bowl movement. The toilet may be equipped with a bidet to make using a restroom convenient and for sanitary purposes.

In this respect, even after a user uses a toilet and the toilet is flushed, water retained in the toilet may be contaminated due to foreign objects remaining therein, raising the possibility of the propagation of microbes (or microscopic organisms).

Also, the propagation of bacteria causes odors, while a bowel movement may also cause an odor from the toilet bowl, resulting in a failure of providing an agreeable environment to a toilet user.

Thus, a device for sterilizing and deodorizing a toilet after a user uses it is required.

Meanwhile, a bidet includes a movable cleaning nozzle for jetting water to the external organs of sex and excretion to clean the same and a movable bidet nozzle for jetting water to the pudenda of a woman.

However, when the nozzle is repeatedly used, erroneously used, or used for an extended period of time, it may be contaminated with excretion, and the excretion may be jetted together with washing water to the external organs of sex and excretion or may clog holes through which washing water is jetted, or bacteria may propagate in the nozzle due to the excretion.

Thus, in order to solve the problem, the nozzle is cleaned to remove excretion, but, in this case, the related art nozzle cleaning method requires a large quantity of washing water to remove excretion or has insufficient cleaning power to completely remove excretion from the nozzle.

DISCLOSURE OF INVENTION

Technical Problem

An aspect of the present invention provides a toilet cleaning apparatus having a bubble supply mechanism devised to sterilize a toilet bowl and prevent feces from being splashed when a user uses the toilet and to prevent an odor coming from the toilet, and a cleaning method of the toilet cleaning apparatus.

An aspect of the present invention also provides a toilet cleaning apparatus having a bubble supply mechanism devised to apply water to a toilet bowl and generating a sufficient quantity of bubbles for cleaning a nozzle within a short period of time.

An aspect of the present invention also provides a toilet cleaning apparatus having a bubble supply mechanism devised to completely remove excretion present on a nozzle to thus allow the nozzle to be maintained in a clean state.

An aspect of the present invention also provides a toilet cleaning apparatus having a bubble supply mechanism devised to apply a bubble film to the toilet bowl to prevent an odor, remove foreign objects within the toilet and clean the toilet.

Solution to Problem

According to an aspect of the present invention, there is provided a toilet cleaning apparatus having a bubble supply mechanism, including; a mixture tank in which raw water supplied from a raw water supply unit, air introduced from an air supply unit, and a cleaning solution supplied from a cleaning solution supply unit are mixed and accommodated; a bubble generation unit provided in the mixture tank and generating bubbles in the raw water, air, and the cleaning solution by using an impeller; and a bubble discharging unit connected to the mixture tank and discharging bubbles generated by the bubble generation unit to a toilet bowl to cover water stored in the toilet.

Preferably, the bubble generation unit may include: a housing provided within the mixture tank and having one side communicating with an outlet of the mixture tank and the other side having a through hole formed therein to allow a fluid including a cleaning solution and air to be introduced therethrough, wherein the impeller is rotatably installed, within the housing and increases contact among air, a cleaning solution, and raw water to facilitate the generation of bubbles.

Preferably, the toilet cleaning apparatus may further include: a nozzle case in which one or more nozzles are movably provided to clean a portion of a human body, wherein the bubble discharge unit is provided in the nozzle, case to discharge bubbles generated by the bubble generation unit to the nozzle for the cleaning thereof.

Preferably, the toilet cleaning apparatus may further include a cleaning member provided in the nozzle case and jetting washing water to the nozzle.

Preferably, the bubble discharge unit may include a bubble inlet connected to an outlet of the mixture tank by a mixed solution flow channel; and a bubble outlet discharging bubbles introduced through the bubble inlet to the nozzle and the toilet bowl.

Preferably, the bubble discharge unit may be connected to a rim outlet discharging washing water introduced through the raw water supply unit to the rim of the toilet and discharge bubbles through the din outlet to cover water stored within the toilet.

Preferably, the toilet cleaning apparatus may further include: a pressurization device installed between the raw water supply unit and the rim outlet to provide pressurization (or pressure) when washing water and bubbles are discharged.

Preferably, the bubble discharge unit may include: a main body installed in the toilet; a bubble input member formed to penetrate the main body and connected to the mixture tank through a mixed solution flow channel to receive bubbles input thereto after being generated by the bubble generation unit; and a bubble output member formed to penetrate the main body and provided to communicate with the toilet bowl to discharge bubbles to the toilet bowl.

Preferably, the bubble discharge unit may include a porous filter provided within the main body and disposed between the bubble input member and the bubble output member.

Preferably, the bubble generation unit may further include: ribs formed on at least one rotary blade of the impeller and an inner circumferential surface of the housing to increase contact between air and the fluid.

Preferably, the mixture tank may include: a first inlet port to which a raw water flow channel connected to the raw water supply unit and an air flow Channel connected to the air supply unit are connected; a second inlet port connected to the cleaning solution supply unit by the medium of a cleaning solution flow path; and an outlet having an entrance formed in a position higher than an entrance of the first inlet port and an entrance of the second input port and connected to the bubble discharge unit through a mixed solution flow channel.

Preferably, the cleaning solution supply unit may include: a cleaning solution storage container having a cleaning solution inlet and a cleaning solution outlet and having a cleaning solution storage space formed therein; and a metering pump connected to the cleaning solution storage container and supplying a pre-set quantity of the cleaning solution stored in the cleaning solution storage container to the mixture tank.

Preferably, the air supply unit may be configured as an air pump generating air and supplying generated air to the mixture pump through an air flow channel.

Preferably, the mixture tank may include: a partition installed to extend downwardly from an inner upper surface between the outlet and the first and second inlet ports.

Preferably, the impeller may be rotated by water pressure from raw water introduced to the mixture tank.

Preferably, the cleaning member may include: a washing water inlet allowing washing water to be introduced therethrough; and an injection hole provided to allow the washing water introduced through the washing water inlet to be jetted to the nozzle, wherein after the nozzle is cleaned by bubbles discharged from the bubble discharge unit, washing water is jetted to the nozzle to rinse the nozzle.

According to another aspect of the invention, there is provided a cleaning method of a toilet cleaning apparatus having a bubble supply mechanism, including: a cleaning solution injecting operation of injecting a cleaning solution into a mixture tank from a cleaning solution supply unit; an air and raw water supplying operation of mixing raw water supplied from a raw water supply unit and air introduced from an air supply unit and supplying the same to the mixture tank; a bubble generating operation of generating bubbles with the raw water, air, and cleaning solution by using an impeller provided within the mixture tank; and a bubble discharging and toilet cleaning operation of discharging bubbles generated during the bubble generating operation to the toilet bowl from the mixture tank to clean the toilet bowl and cover water stored in the toilet.

Preferably, the bubble discharging and toilet cleaning operation may include: an operation of providing bubbles generated in the mixture tank to a rim of the toilet; and an operation of providing washing water introduced from the raw water supply unit to the rim of the toilet and discharging bubbles to a rim outlet communicating with the toilet bowl by flowing washing water.

Preferably, the operation of discharging bubbles to the rim outlet may include: a pressurization device driving operation of driving a pressurization device installed between the raw water supply unit and the rim outlet to provide pressurization when washing water and bubbles are discharged.

Preferably, the bubble discharging and toilet cleaning operation may include: discharging bubbles generated in the mixture tank to the nozzle provided in the nozzle case in order to clean the nozzle and the toilet with bubbles; and a nozzle cleaning operation of jetting washing water introduced from the raw water supply unit to the nozzle for the cleaning thereof.

Advantageous Effects of Invention

Thus, in the case of the toilet cleaning apparatus having a bubble supply mechanism and a cleaning method thereof according to an embodiment of the present invention, since bubbles including a cleaning solution containing a sterilization ingredient mixed therein form a bubble film on the surface of water stored within the toilet, the toilet bowl can be sterilized, and when a user uses the toilet, feces may be prevented from being splashed by the bubble film, thus preventing an odor from being emitted (given off) from the toilet bowl.

Also, according to an embodiment of the present invention, since bubbles are generated by installing an impeller within the mixture tank in which a cleaning solution, raw water, and air are mixed, a sufficient quantity of bubbles for covering water within the toilet and cleaning a nozzle can be generated within a short time.

Also, according to an embodiment of the present invention, since the nozzle can be cleaned with bubbles generated by the bubble generation unit, feces can be completely removed from the nozzle, and thus, the nozzle can be maintained in a state of cleanliness at all the times.

Also, according to an embodiment of the present invention, since air is supplied to the mixture tank in which a cleaning solution and raw water are mixed, bubble generation can be increased.

Also, according to an embodiment of the present invention, since the bubble discharge unit is connected to the rim outlet, an odor, or the like, can be prevented by the bubble film coated within the toilet bowl and a foreign object on the inner surface of the toilet can be removed and cleaned with bubbles.

MODE FOR THE INVENTION

Figure 1:
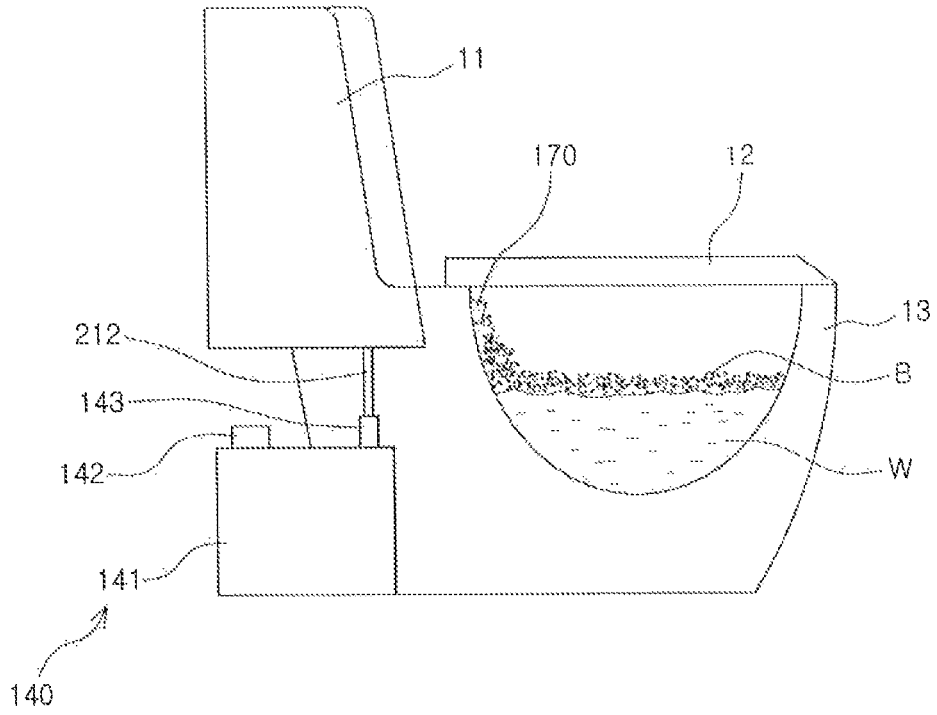
FIG. 1 a view illustrating an installed state of a toilet cleaning apparatus having a bubble supply mechanism according to an embodiment of the present invention.

Hereinafter, embodiments of the present invention will be described in detail with reference to the accompanying drawings.

First, the embodiments described hereinafter are appropriate for understanding technical features of a toilet cleaning apparatus having a bubble supply mechanism and a cleaning method of a toilet cleaning apparatus according to the present invention. However, the present invention is not limited to the embodiments described hereinafter or technical features of the present invention are not limited by the described embodiments. Various modifications may be undertaken within the scope of the present invention.

As shown in the embodiment illustrated in FIGS. 1 through 7, a toilet cleaning apparatus having a bubble supply mechanism according to an embodiment of the present invention may include a mixture tank 150, a bubble generation unit 160 and a bubble discharge unit 170.

Raw water supplied from a raw water supply unit 120, air introduced from an air supply unit 130, and a cleaning solution supplied from a cleaning solution supply unit 140 may be mixed and accommodated in the mixture tank 150.

Here, the raw water supply unit 120 may be tap water or water stored in a water storage tank. A flow channel changing valve 121 is connected to the raw water supply unit 120 to supply raw water to the mixture tank 150.

The cleaning solution supply unit 140 may store or generate a cleaning solution to supply it to the mixture tank 150. Here, the cleaning solution may be a sterilized solution including a sterilization ingredient. A surfactant as a material absorbed at an interface to reduce surface tension may be added to the mixture solution containing the cleaning solution. In addition, various aromas, medicinal herbs, and the like, may be used for fragrance.

The air supply unit 130 may generate air.

Here, a method of generating air by the air supply unit 130 is not limited and may be variously modified as long as air can be mixed in a solution to generate bubbles B as described hereinafter.

In this manner, since air is introduced together as well as the cleaning solution and raw water to the mixture tank 150, the bubble generation unit 160 installed in the mixture tank 150 may easily generate bubbles as described hereinafter.

The bubble generation unit 160 is disposed within the mixture tank 150 and may generated bubbles with raw water, air, and a cleaning solution by using an impeller 161.

Namely, a cleaning solution and raw water are supplied to the mixture tank 150 and air is simultaneously supplied from the air supply unit 130. In the case of a fluid containing air, as contact between air and the fluid is increased by the impeller 161 provided in the bubble generation unit 160, bubble generation may be promoted.

Meanwhile, the bubble discharge unit 170 is connected to the mixture tank 150 and discharges bubbles generated in the bubble generation unit 160 to the toilet bowl 13 to cover water stored in the toilet bowl 13.

Figure 2:
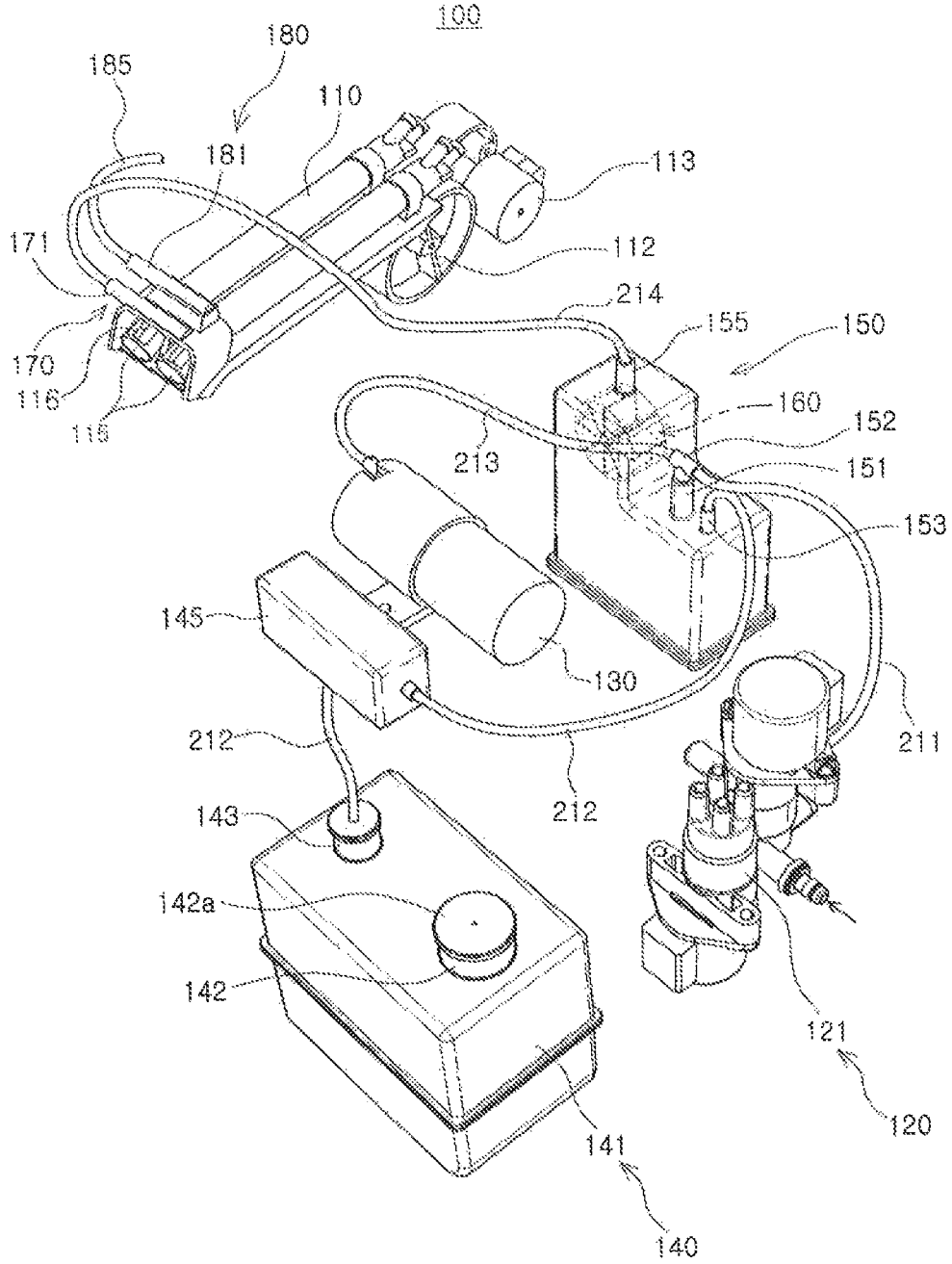
FIG. 2 is a view illustrating a configuration of the toilet cleaning apparatus having a bubble supply mechanism according to an embodiment of the present invention.

Namely, as shown in the embodiment illustrated in FIG. 2, the bubble discharge unit 170 may be connected to the mixture tank 150 by the medium of the mixed solution flow channel 214, and discharge bubbles generated in the mixture tank 150 to the toilet bowl 13.

Here, as shown in the embodiment illustrated in FIG. 1, the bubble discharge unit 170 may be installed in a bidet body 11 and protruded to the toilet bowl 13. Accordingly, bubbles B may be discharged to the toilet bowl 13 to cover water W stored in the toilet 13.

The toilet cleaning apparatus according to an embodiment of the present invention configured as described above may form a bubble film by coating water stored in the toilet 13 with bubbles generated by supplying air to a mixture solution containing a cleaning solution. Namely, bubbles coated within the toilet 13 are maintained to be as fine as possible to form a film covering the entirety of water stored within the toilet 13.

Here, since the bubbles include a cleaning solution containing a sterilization component, bacteria can be removed from water within the toilet 13.

Also, when the user uses the toilet, feces is prevented from being splashed by the bubble film and a smell is prevented from emanating, thus preventing an odor.

Meanwhile, the toilet cleaning apparatus having a bubble supply mechanism according to an embodiment of the present invention may further include, a nozzle case 110 in which one or more nozzles for cleaning a portion of a human body is movable. Here, the nozzle may be installed in the bidet body 11 when the toilet cleaning apparatus 100 according to an embodiment of the present invention is installed in the bidet as shown in the illustrated embodiment.

Also, the bubble discharge unit 170 is provided on the nozzle case and discharges bubbles generated by the bubble generation unit 160 to the nozzle for the cleaning thereof.

Namely, as illustrated in FIG. 2, the bubble discharge unit 170 may be installed on the nozzle case 110 installed within the bidet body 11. Preferably, the bubble discharge unit 170 may be installed in a position in which it may discharge bubbles to a nozzle tip 116 when the nozzle tip 116 is in its original position.

The nozzle case 110 may include an installation cover 111 integrally formed in a front end portion thereof, a motor 112 moving a nozzle 115 forwardly and backwardly, and a flow channel changing valve 113 to supply water to the nozzle 115. However, the nozzle case 110 is not limited to the illustrated embodiment and may be variously modified as long as the nozzle 115 is movably installed and the bubble discharge unit 170 is provided.

Accordingly, when bubbles generated by the bubble discharge unit 170 are discharged to the toilet bowl 13, the bubbles are discharged to the nozzle 115, so the nozzle 15 may also be cleaned.

Thus, in the toilet cleaning apparatus 100 having a bubble supply mechanism according to an embodiment of the present invention, water stored in the toilet 13 is covered with the bubbles generated by the bubble generation unit 160, providing a deodorization effect, an effect of cleaning the toilet bowl 13, and cleaning the nozzle 115.

Meanwhile, the mixture tank 150 may include a first inlet port 151 to which a raw water flow channel 211 connected to the raw water supply unit 120 and an air flow channel 213 connected to the air supply unit 130 are connected, a second inlet port 153 connected to the cleaning solution supply unit 150 by the medium of a cleaning solution flow path 212, and an outlet 155 having an entrance 155*a* formed in a position higher than an entrance 151*a* of the first inlet port and an entrance 153*a* of the second input port and connected to the bubble discharge unit 170 through a mixed solution flow channel 214.

Here, a T-shaped tube 152 is connected to the first inlet port 151 to connect the raw water flow channel 211, the air flow channel 213, and the first input port 151. Accordingly, raw water supplied from the raw water supply unit 120 and air supplied from the air supply unit 130 may be simultaneously introduced to the mixture tank 150.

Also, the outlet 155 may be connected to the mixed solution flow channel 214 connected to the bubble discharge unit 170 to discharge bubbles generated by the bubble generation unit 160 to the bubble discharge unit 170 through the mixed solution flow channel 214.

Here, the inlet 155*a* of the outlet 155 may be formed in a position higher than the entrance 151*a* of the first inlet port and the inlet 153*a* of the second inlet port.

Namely, a mixture solution including a cleaning solution introduced to the mixture tank 150 is discharged through the outlet 155 by a water pressure from raw water introduced to the first inlet port 151, so the entrance 155*a* of the outlet 155 may be formed to be higher than the entrance 151*a* of the first inlet port and the entrance 153*a* of the second inlet port to facilitate mixing and discharging of a fluid.

Meanwhile, the mixture tank 150 may include a partition 157 installed to extend downwardly from an inner upper surface between the outlet 155 and the first and second inlet ports 151 and 153.

Since the path along which the introduced raw water, cleaning solution, and air are discharged is lengthened by the partition 157, the introduced raw water, cleaning solution, and air may be sufficiently mixed and discharged.

Meanwhile, the cleaning solution supply unit 140 may include a cleaning solution storage container 141 having a cleaning solution inlet 142 and a cleaning solution outlet 143 and having a cleaning solution storage space formed therein, and a metering pump 145 connected to the cleaning solution storage container 141 and supplying a pre-set quantity of the cleaning solution stored in the cleaning solution storage container 141 to the mixture tank 150.

Namely, as shown in the embodiment illustrated in FIG. 2, the cleaning solution storage container 141 may include the outlet 143 to which the cleaning solution flow channel 212 connected to the metering pump 145 is connected and the cleaning solution inlet 142 provided to be opened and closed to input a cleaning solution. Here, a stopper 142*a* may be installed in the cleaning solution inlet 142.

An installation position of the cleaning solution storage container 141 is not limited. For example, as shown in the embodiment illustrated in FIG. 1, the cleaning solution storage container 141 may be installed outside the toilet 13 or may be integrally formed with the toilet 13. However, the present invention is not limited thereto and the cleaning solution storage container 141 may be provided within the bidet body 11. Reference numeral 12 denotes a sheet.

Also, as mentioned above, the cleaning solution stored in the cleaning solution storage container 141 may contain a sterilization ingredient.

The metering pump 145 may be connected to the cleaning solution storage container 141 by the medium of the cleaning solution flow channel 212 and may be configured to supply a pre-set quantity of cleaning solution to the mixture tank 150. The metering pump 145 may be connected to the mixture tank 150 by the medium of the cleaning solution flow channel 212.

Accordingly, a quantity of cleaning solution for easily forming bubbles may be supplied to the mixture tank 150. A type of the metering pump 145 is not limited and any metering pump may be used as long as it can supply a pre-set quantity of cleaning solution to the mixture tank 150.

Meanwhile, the air supply unit 130 may be configured as an air pump generating air and supplying the same to the mixture tank 150 through the air flow channel 213.

Namely, the air pump 130 includes an air generation unit (not shown) to generate air, and the air flow channel 213 may be connected to an air supply hole formed on one side of the air pump 130. The air flow channel 213 may be connected to an air inlet of the bubble discharge unit 170 to allow air generated from the air pump to be supplied to the bubble discharge unit 170. Besides the structure in which the air pump is connected to the bubble discharge unit 170 by the medium of the air flow channel 213, any known structure may also be used.

Figure 3:
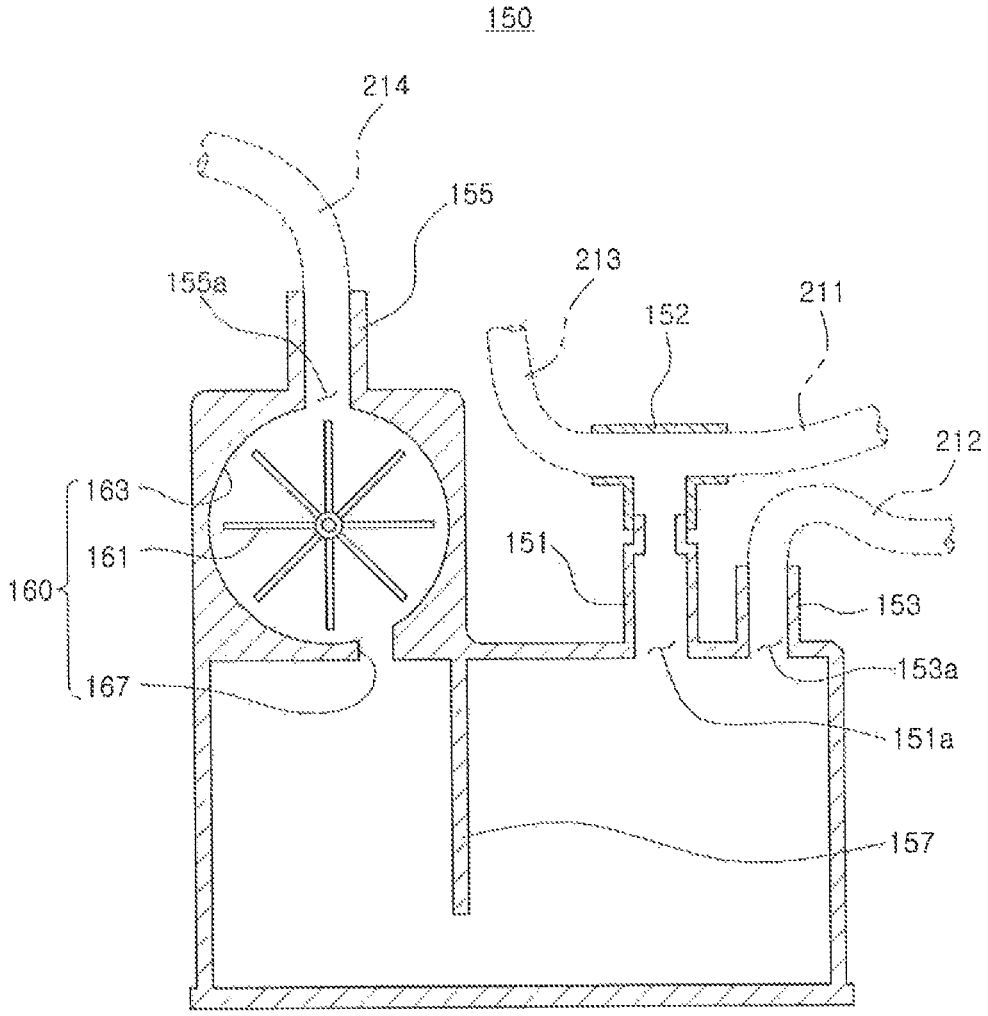
FIG. 3 is a cross-sectional view of a mixture tank applied to the toilet cleaning apparatus having a bubble supply mechanism according to an embodiment of the present invention.

Meanwhile, as shown in the embodiment illustrated in FIG. 3, the bubble generation unit 160 may include a housing 163 provided within the mixture tank 150, having one side communicating with the outlet 155 of the mixture tank 150, and having a through hole 167 formed in the other side thereof to allow a fluid including a cleaning solution and air to be introduced therethrough. The impeller 161 may be rotatably installed within the housing 163 to increase contact between air, the cleaning solution, and the raw water to facilitate generation of bubbles.

Namely, as illustrated, the housing 163 in which the impeller 161 is installed may be installed in the outlet 155 side of the mixture tank 150. Thus, a path along which the cleaning solution and raw water introduced to the mixture tank 150 is lengthened to allow the cleaning solution and raw water to be sufficiently mixed.

Air introduced to the mixture tank 150 is mixed with the mixture solution of the cleaning solution and raw water to generate bubbles, and here, the impeller 161 is provided in a discharge side to increase generation of bubbles, whereby a quantity of bubbles, which is insufficient with the simple introduction of air, can be increased and discharged to the bubble discharge unit 170.

Here, the through hole 167 may be formed in one side of a lower surface of the housing 163 in which the impeller 161 is installed. This is to rotate the impeller 161 by fluid pressure from fluid including the cleaning solution introduced to the housing 163.

Figure 4:
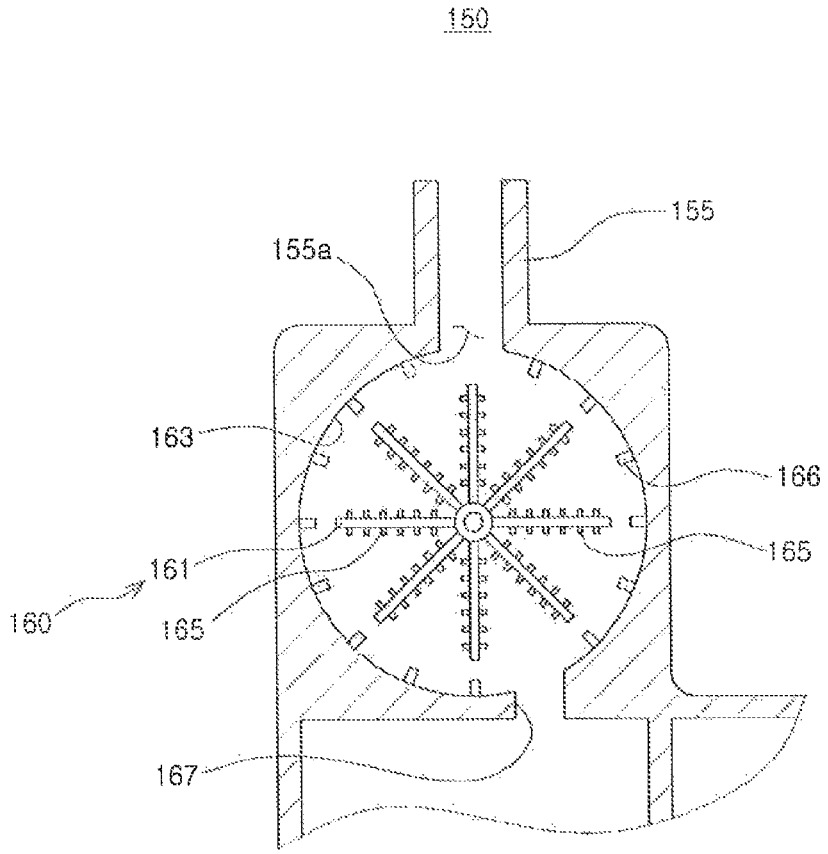
FIG. 4 is a cross-sectional view of another example of a mixture tank applied to the toilet cleaning apparatus having a bubble supply mechanism according to an embodiment of the present invention.

Meanwhile, as shown in the embodiment illustrated in FIG. 4, the bubble generation unit 160 may further include ribs 165 and 166 formed on at least one rotary blade of the impeller 161 and an inner circumferential surface of the housing 163 to increase contact between air and the fluid.

Namely, since the ribs 165 and 166 are formed to be protruded from the surfaces of the rotary blades or the inner circumferential surface of the housing 163 to increase frictional force between air and the fluid introduced into the housing 163 to increase generation of bubbles. Thus, a time required for generating bubbles sufficient for covering the toilet bowl 13 can be shortened.

Meanwhile, the impeller 161 may be rotated by water pressure from raw water introduced to the mixture tank 150.

Namely, when a fluid including a cleaning solution introduced to the mixture tank 150 by water pressure from raw water introduced through the first inlet port 151 flows to the through hole 167, the impeller 161 may be rotated by the fluid pressure at which the fluid is introduced.

However, the rotation of the impeller 161 is not limited to the rotation by water pressure from raw water and various modifications may be implemented as long as a sufficient quantity of bubbles may be generated by using the introduced fluid. For example, the impeller 161 may be rotated by a motor.

The cleaning solution and raw water introduced to the mixture tank 150 by the bubble generation unit 160 formed thusly are sufficiently mixed with air to increase bubble generation. Thus, a sufficient quantity of bubbles for covering water stored in the toilet bowl 13 and cleaning the nozzle 115 can be generated within a short time.

Figure 5:
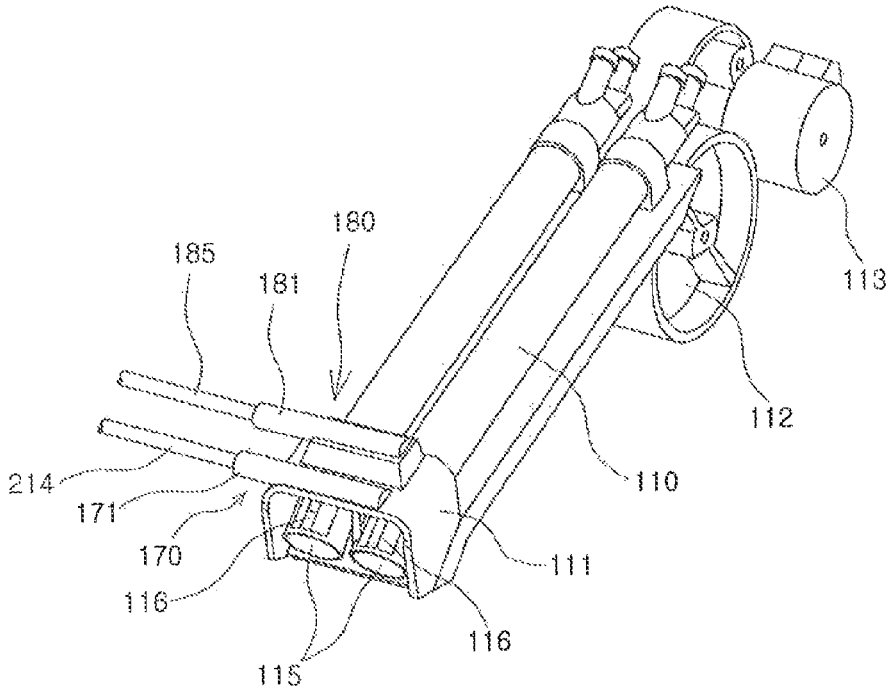
FIG. 5 is a perspective view of a nozzle case applied to the toilet cleaning apparatus having a bubble supply mechanism according to an embodiment of the present invention.
Figure 6:
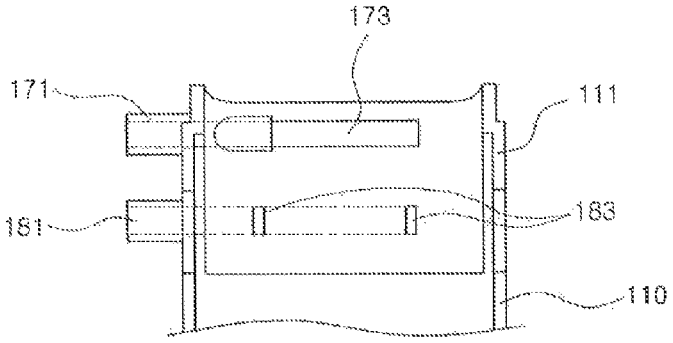
FIG. 6 is a rear view of a bubble discharge unit illustrated in FIG. 5.
Figure 7:
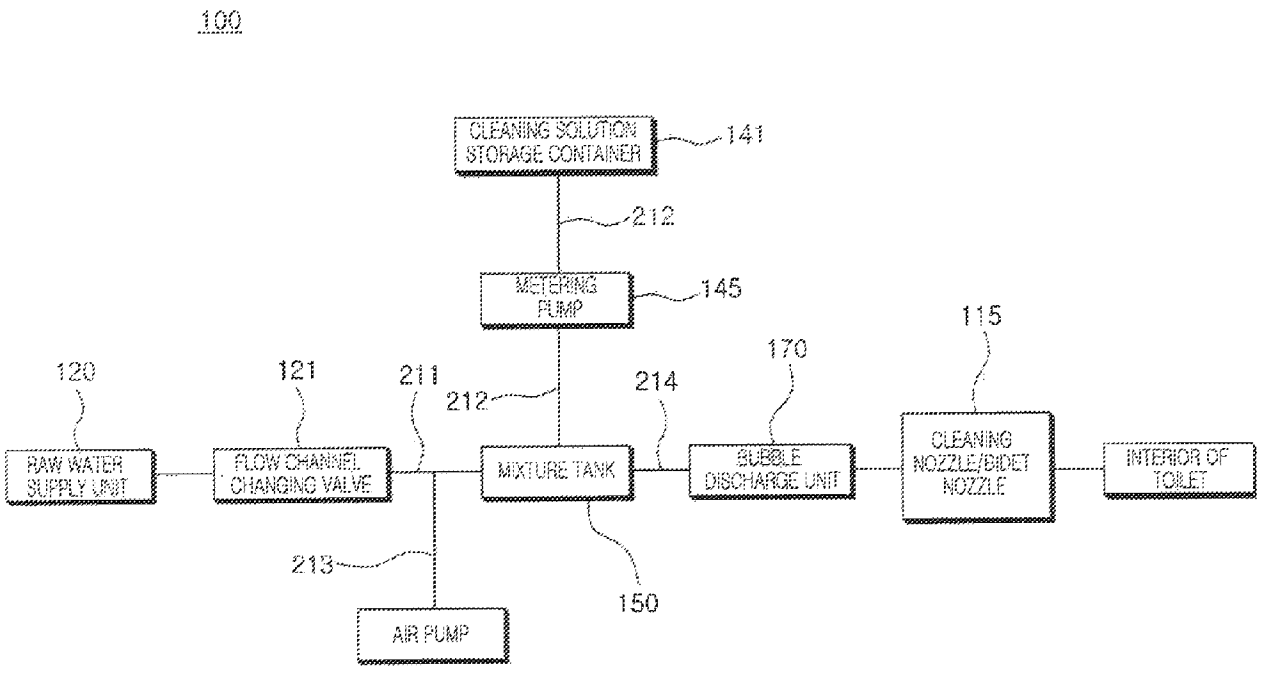
FIG. 7 is a block diagram of the toilet cleaning apparatus having a bubble supply mechanism according to an embodiment of the present invention.

Meanwhile, as shown in the embodiment illustrated in FIGS. 2, 5, and 6, the bubble discharge unit 170 may include a bubble inlet 171 connected to the outlet 155 of the mixture tank 150 by a mixed solution flow channel 214 and a bubble outlet 173 for discharging bubbles introduced through the bubble inlet 171 to the nozzle 115 and the toilet bowl 13.

Here, the bubble inlet 171 and the bubble outlet 173 may be formed in an installation cover 111 integrally formed with the nozzle case 110. The bubble outlet 173 may be formed to face downward and have a size sufficient for discharging bubbles to the nozzle tip 116 provided on the nozzle 115.

However, the installation of the bubble inlet 171 and the bubble outlet 173 is not limited to the illustrated embodiment and the bubble inlet 171 and the bubble outlet 173 may be variously modified as long as they can simultaneously discharge bubbles to the nozzle 115 and the toilet bowl 13. The shape of the bubble inlet 171 and the bubble outlet 173 is not limited to the illustrated embodiment and may be variously modified.

Meanwhile, as shown in the embodiment illustrated in FIGS. 2, 5, and 6, the toilet cleaning apparatus 100 having a bubble supply mechanism according to an embodiment of the present invention may further include a cleaning member 180 provided in the nozzle case 110 and jetting washing water to the nozzle 115.

Here, the cleaning member 180 may include a washing water inlet 181 allowing washing water to be introduced therethrough and an injection hole 183 provided to allow the washing water introduced through the washing water inlet 181 to be jetted to the nozzle 115. After the nozzle 115 is cleaned by bubbles discharged from the bubble discharge unit 170, washing water may be jetted to the nozzle 115 to rinse the nozzle 115.

The washing water inlet 181 and the injection hole 183 may be formed on the installation cover 111 integrally installed in the nozzle case 110. Preferably, the washing water inlet 181 may be installed to be adjacent to a bubble outlet. A washing water flow channel 185 supplying washing water may be connected to the washing water inlet 181.

Thus, washing water may be introduced through the washing water inlet 181 and jetted to the nozzle 115 through the injection hole 183. Here, the injection hole 183 may be formed in a position at which a front end portion of the nozzle 115, i.e., the nozzle tip 116, smeared with feces, may be cleaned. For example, when two nozzles 115 are formed in the nozzle case 110, two injection holes 183 may be formed to correspond to the positions of the front ends of the respective nozzles 115. However, the present invention is not limited thereto and only a single hole corresponding to the positions of the two nozzles 115, like the illustrated bubble discharge hole 173, may be formed.

When the nozzle 115 is cleaned by bubbles discharged from the bubble discharge unit 170, the cleaning member 180 may jet washing water to the nozzle 115 to clean a cleaning solution remaining in the nozzle 115.

However, the operation of the cleaning member 180 is not limited thereto and, for example, the cleaning member 180 may jet washing water to clean the nozzle 115, regardless of discharge of bubbles by the bubble discharge unit 170.

Thus, since the nozzle 115 is cleaned with bubbles discharged from the bubble discharge unit 170 and washing water is jetted to the nozzle 115, feces can be completely removed from the nozzle in comparison to the related art in which the nozzle is cleaned only with washing water.

Figure 8:
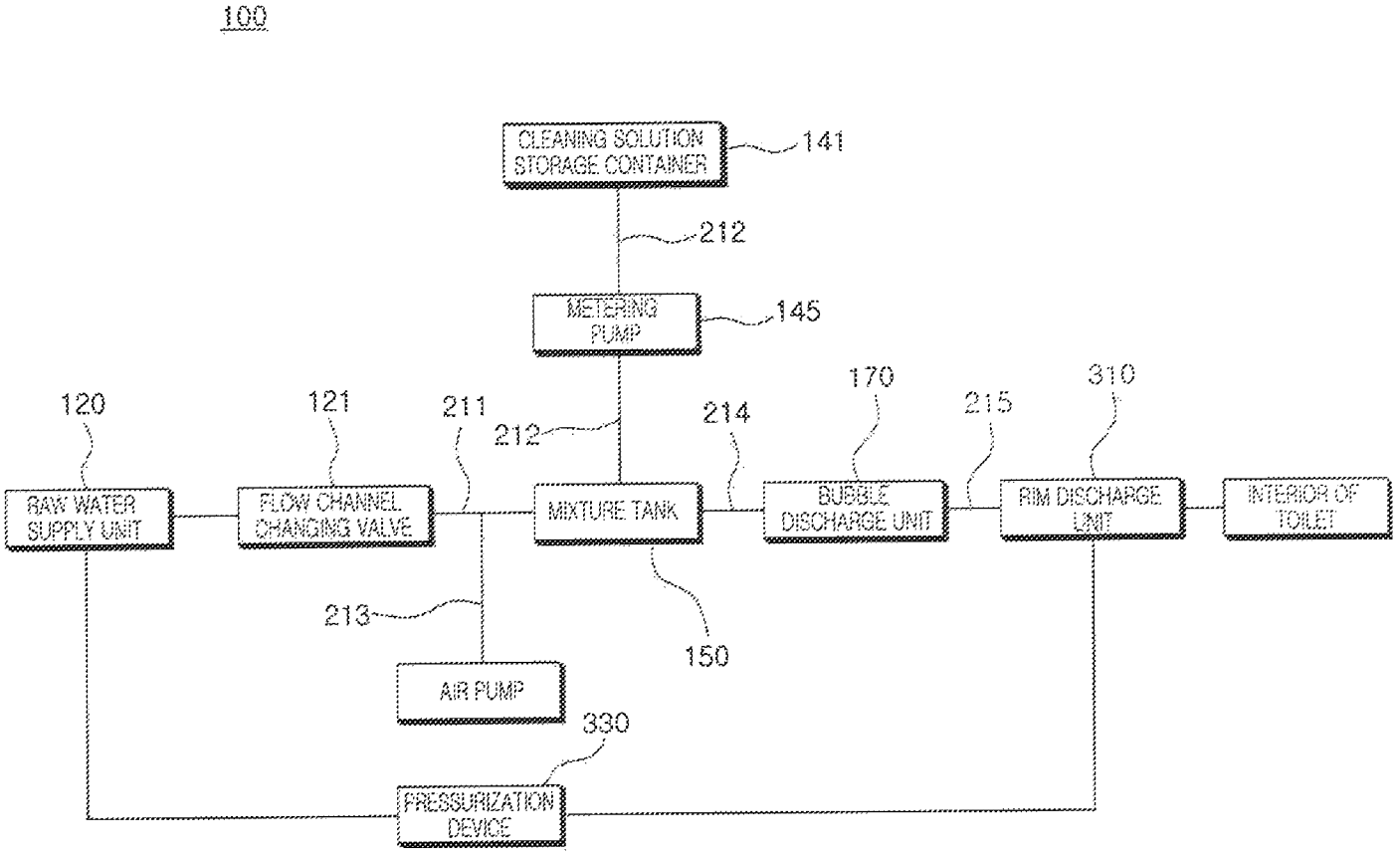
FIG. 8 is a block diagram of the toilet cleaning apparatus having a bubble supply mechanism according to another embodiment of the present invention.

FIG. 8 illustrates a toilet cleaning apparatus 100 having a bubble supply mechanism according to another embodiment of the present invention.

The toilet cleaning apparatus 100 having a bubble supply mechanism according to another embodiment of the present invention is different from the former embodiment, in that the bubble discharge unit 170 is connected to a rim outlet 310. Hereinafter, a detailed description of the same configuration as that of the former embodiment will be omitted and the bubble discharge unit 170 will largely described.

Referring to the embodiment illustrated in FIG. 8, the bubble discharge unit 170 is connected to the rim outlet 310 discharging washing water introduced through a raw water supply unit 120 toward the rim of the toilet, and water stored within the toilet may be covered with bubbles discharged through the rim outlet 310.

The rim outlet 310 may be connected to a discharge pipe (not shown) connected to the rim of the toilet to discharge washing water to the rim. Here, washing water may be introduced from the raw water supply unit 120 provided as a water tank installed in the toilet, a raw water pipe of tap water, or the like, and discharged to the rim outlet 310 to clean the inner surface of the toilet 13.

Also, the bubble discharge unit 170 is connected to the rim outlet 310 through a bubble flow channel 215 to supply bubbles to the rim, and bubbles may be discharged to the rim outlet 310 together with washing water by inflow force of washing water introduced to the rim. Thus, bubbles B discharged to the rim outlet 310 are discharged along the inner surface of the toilet to clean the inner surface of the toilet and cover water stored within the toilet.

Thus, in the toilet cleaning apparatus 100 having a bubble supply mechanism according to another embodiment of the present invention, since the bubble discharge unit 170 is connected to the rim outlet 310, an odor, or the like, can be prevented by the bubble film coated within the toilet and foreign objects on the inner surface of the toilet can be removed and cleaned.

Meanwhile, the toilet, cleaning apparatus 100 having a bubble supply mechanism according to another embodiment of the present invention may further include a pressurization device 330 installed between the raw water supply unit 120 and the rim outlet 310 to provide pressurization when washing water and bubbles are discharged. The pressurization device 330 may include a pressurization unit (not shown) compressed by washing water introduced to the raw water supply unit 120 and pressurizing washing water discharged through the rim outlet 310 by restoring force to discharge washing water outwardly.

Namely, the pressurization device 330 may be installed between the rim outlet 310 and the raw water supply unit 120 to quickly and smoothly discharge toilet washing water and bubbles discharged through the rim outlet 310 to maximize a cleaning effect of the inner surface of the toilet.

Here, for example, the pressurization unit provided in the pressurization device 330 may be provided as an elastic member, and may be compressed or restored by washing water introduced through the raw water inlet and opening of the rim outlet 310 to pressurize discharged washing water and bubbles.

Figure 9:
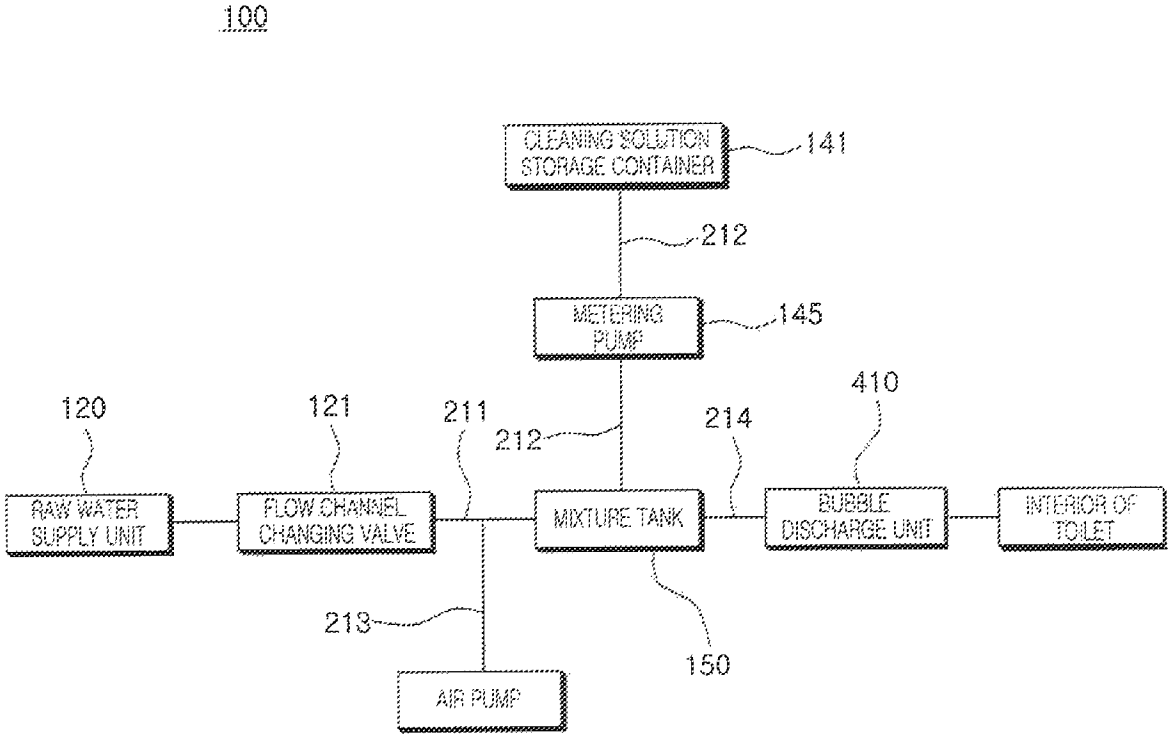
FIG. 9 is a block diagram of the toilet cleaning apparatus having a bubble supply mechanism according to another embodiment of the present invention.
Figure 10:
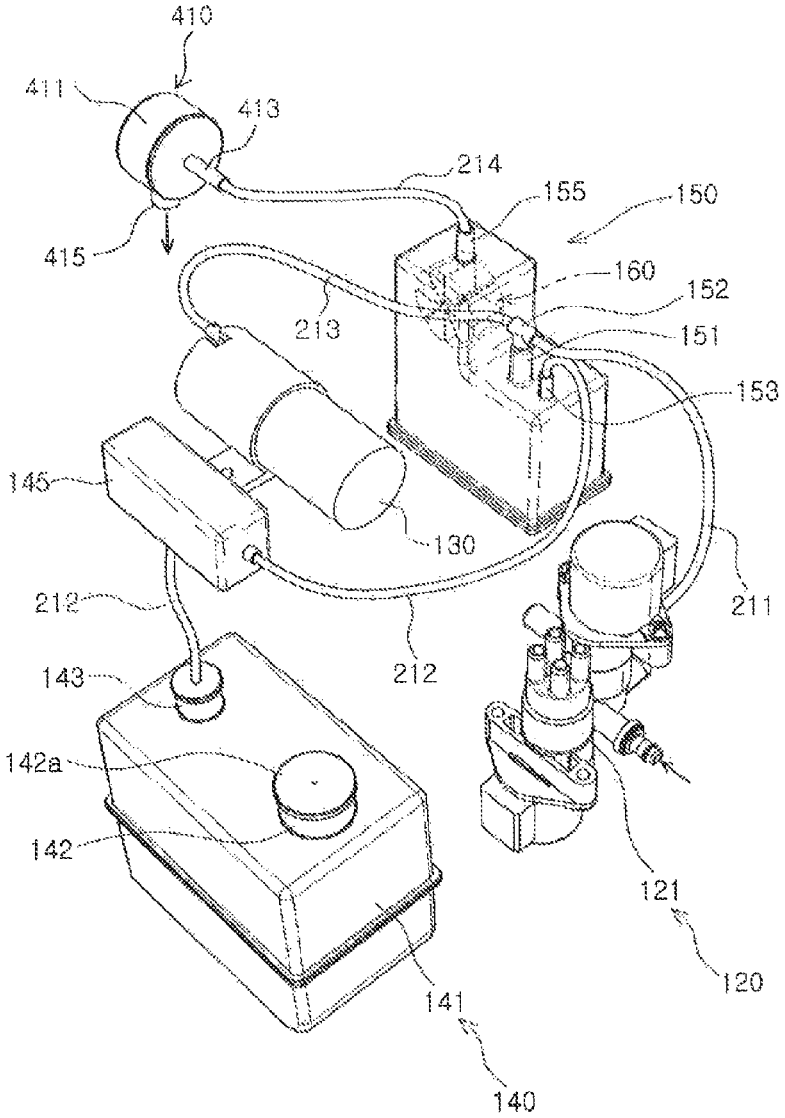
FIG. 10 is a view schematically illustrating a configuration of the toilet cleaning apparatus having a bubble supply mechanism according to another embodiment of the present invention.
Figure 11:
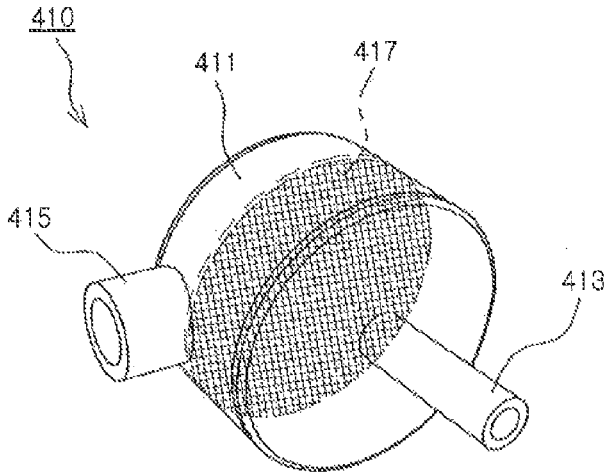
FIG. 11 is a perspective view of a bubble discharge unit applied to the toilet cleaning apparatus having a bubble supply mechanism according to another embodiment of the present invention.

FIGS. 9 through 11 illustrate a toilet cleaning apparatus 100 having a bubble supply mechanism according to another embodiment of the present invention.

The toilet cleaning apparatus 100 having a bubble supply mechanism according to another embodiment of the present invention is different from the former embodiment, in that a bubble discharge unit 410 is connected to the toilet bowl by a separate member such that it directly communicates therewith. Hereinafter, a detailed description of the same configuration as that of the former embodiment will be omitted and the bubble discharge unit 410 will largely be described.

Referring to FIGS. 9 through 11, in the toilet cleaning apparatus 100 having a bubble supply mechanism according to another embodiment of the present invention, the bubble discharge unit 410 may include a main body 411 installed in the toilet, a bubble input member 413 formed to penetrate the main body 411 and connected to the mixture tank 150 through a mixed solution flow channel 214 to receive bubbles input thereto after being generated by the bubble generation unit; and a bubble output member 415 formed to penetrate the main body and provided to communicate with the toilet bowl to discharge bubbles to the toilet bowl.

Namely, in this embodiment, bubbles generated in the mixture tank 150 may be coated on the inner surface of the toilet by an extra member connected to the toilet bowl, without passing through the nozzle or the rim outlet 310.

Here, the main body 411 may be installed to be protruded from an inner surface of the toilet, but the present invention is not limited thereto and the main body 411 may be modified as long as it is installed to communicate with the inner surface of the toilet.

Also, referring to FIGS. 10 and 11, the bubble input member 413 may be installed on one side of the main body 411 and connected to the mixture tank 150 by the medium of the mixed solution flow channel 214 to receive bubbles which have been generated as raw water and a cleaning solution were mixed, from the mixture tank 150.

In this manner, bubbles may be introduced to the main body 411 through the bubble input member 413 and subsequently discharged to the inner surface of the toilet through the bubble output member 415 installed to communicate with the toilet bowl. The bubbles may cover water W stored within the toilet, forming a bubble film.

Meanwhile, the bubble discharge unit 170 may include a porous filter 417 provided within the main body 411 and disposed between the bubble input member 413 and the bubble output member 415.

Thus, when bubbles are introduced to the bubble discharge unit 410, they may pass through the porous filter 417 before being discharged to the bubble output member 415. Thus, bubbles can be changed into air bubbles having a small size by the porous filter 417 so as to be discharged to the bubble output member 415.

In this manner, since bubbles are changed into air bubbles having a small size through the porous filter 417, they may easily spread on the surface of water stored within the toilet.

Hereinafter, a cleaning method of a toilet cleaning apparatus having a bubble supply mechanism according to another embodiment of the present invention will be described with reference to FIGS. 12 and 13.

A detailed description of elements having the same configuration as those of the toilet cleaning apparatus 100 having a bubble supply mechanism will be omitted.

The cleaning method of the toilet cleaning apparatus 100 having a bubble supply mechanism according to another embodiment of the present invention may include a cleaning solution injecting operation (S110) of injecting a cleaning solution from the cleaning solution supply unit 140 to the mixture tank 150, an air and raw water supplying operation (S130) of mixing raw water supplied from the raw water supply unit 120 and air introduced from an air supply unit and supplying the same to the mixture tank 150, a bubble generating operation (S150) of generating bubbles with the raw water, air, and a cleaning solution by using an impeller provided within the mixture tank 150; and a bubble discharging and toilet cleaning operation (S170) of discharging bubbles generated during the bubble generating operation to the toilet bowl from the mixture tank 150 to clean the toilet bowl and cover water stored in the toilet.

Here, in the cleaning solution injecting operation (S110), the metering pump 145 may be operated for a certain period of time (e.g., ten seconds) to supply a cleaning solution from the cleaning solution storage container 141 to the mixture tank 150.

Thereafter, in the air and raw water supplying operation (S130), the cleaning solution, air and raw water may be introduced to the mixture tank 150 after the cleaning solution is introduced to the mixture tank 150.

The impeller 161 is operated for a certain period of time to generate bubbles with raw water, air, and the cleaning solution within the mixture tank 150. The bubbles are discharged to the toilet through the bubble discharge unit to form a bubble film covering a surface of water stored within the toilet, thus preventing a generation of an odor and cleaning the toilet.

Figure 12:
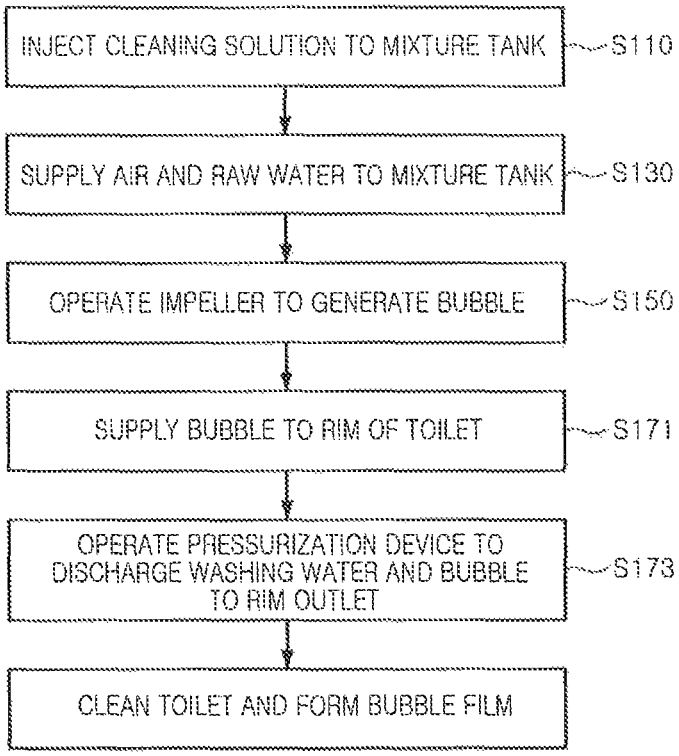
FIG. 12 is a flow chart illustrating a cleaning method of a toilet cleaning apparatus having a bubble supply mechanism according to an embodiment of the present invention.

Meanwhile, referring to FIG. 12, the bubble discharging and toilet cleaning operation (S170) may include: an operation (S171) of providing bubbles generated in the mixture tank 150 to a rim of the toilet, and an operation (S173) of providing washing water introduced from the raw water supply unit to the rim of the toilet and discharging bubbles to the rim outlet 310 communicating with the toilet bowl by flowing washing water.

Preferably, the operation of discharging bubbles to the rim outlet may include a pressurization device driving operation of driving the pressurization device 330 installed between the raw water supply unit and the rim outlet to provide pressurization when washing water and bubbles are discharged.

Namely, after a certain quantity of bubbles is first discharged to the rim of the toilet, the bubbles may be discharged to the toilet by water pressure of washing water discharged to the rim. Here, the pressurization device 330 may pressurized the discharged bubbles and washing water to increase a discharge speed.

Accordingly, the speed at which generated bubbles are discharged to the toilet is increased, and thus, bubbles are advantageously discharged to the toile at the increased speed. Also, since bubbles are discharged rapidly, bubbles discharged to the toilet rotate on the inner surface of the toilet, and thus, the inner surface of the toilet can be advantageously cleaned.

Figure 13:
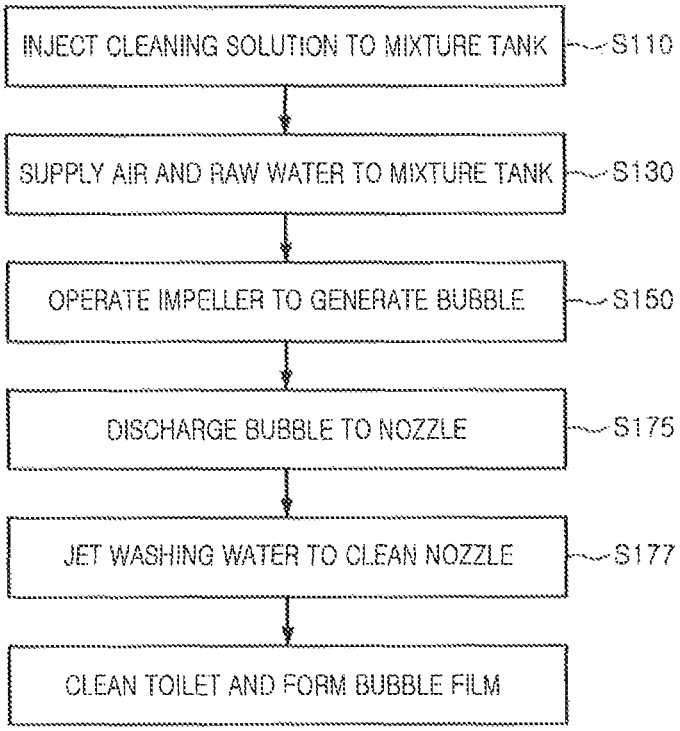
FIG. 13 is a flow chart illustrating a cleaning method of a toilet cleaning apparatus having a bubble supply mechanism according to another embodiment of the present invention.

Meanwhile, referring to FIG. 13, the bubble discharging and toilet cleaning operation. (S170) may include an operation (S175) of discharging bubbles generated in the mixture tank 150 to the nozzle provided in the nozzle case in order to clean the nozzle and the toilet with bubbles, and a nozzle cleaning operation (S177) of jetting washing water introduced from the raw water supply unit to the nozzle 115 to clean the nozzle 115.

Namely, a predetermined quantity of discharged bubbles may be discharged to the nozzle 115 to clean the nozzle 115 and subsequently discharged to the toilet bowl. Thus, both the nozzle and the toilet can be cleaned with the bubbles generated in the mixture tank 150. A cleaning solution remaining in the nozzle 115 due to bubbles may be completely removed by washing water jetted from the cleaning member.

As described above, in the case of the toilet cleaning apparatus having a bubble supply mechanism and a cleaning method thereof according to an embodiment of the present invention, since bubbles including a cleaning solution containing a sterilization ingredient mixed therein forms a bubble film on the surface of water stored within the toilet, the toilet bowl can be sterilized, and when a user uses the toilet, feces is prevented from being splashed by the bubble film, thus preventing an odor from emitting (giving off) from the toilet bowl.

Also, since bubbles are generated by installing an impeller within the mixture tank, a sufficient quantity of bubbles for covering water within the toilet and cleaning a nozzle can be generated within a short time. In addition, since the nozzle can be cleaned with bubbles generated by the bubble generation unit, feces can be completely removed from the nozzle, and thus, the nozzle can be maintained in a state of cleanliness at all times.

Moreover, since the bubble discharge unit is connected to the rim outlet, an odor, or the like, can be prevented by the bubble film coated within the toilet bowl and a foreign object on the inner surface of the toilet can be removed and cleaned with bubbles.

While the present invention has been shown and described in connection with the embodiments, it will be apparent to those skilled in the art that modifications and variations can be made without departing from the spirit and scope of the invention as defined by the appended claims.

The invention claimed is:

1. A toilet cleaning apparatus having a bubble supply mechanism, the apparatus comprising:

a mixture tank in which raw water supplied from a raw water supply unit, air introduced from an air supply unit, and a cleaning solution supplied from a cleaning solution supply unit are mixed and accommodated;

a bubble generation unit provided in the mixture tank and generating bubbles with the raw water, air, and the cleaning solution by using an impeller; and a bubble discharging unit connected to the mixture tank and discharging bubbles generated by the bubble generation unit to the toilet bowl to cover water stored in the toilet, wherein the mixture tank comprises:

a first inlet port to which a raw water flow channel connected to the raw water supply unit and an air flow channel connected to the air supply unit are connected;

a second inlet port connected to the cleaning solution supply unit by the medium of a cleaning solution flow path;

an outlet having an entrance formed in a position higher than an entrance of the first inlet port and an entrance of the second input port and connected to the bubble discharge unit through a mixed solution flow channel; and a partition installed to extend downwardly from an inner upper surface between the outlet and the first and second inlet ports.

2. The toilet cleaning apparatus of claim 1, wherein the bubble generation unit comprises:

a housing provided within the mixture tank and having one side communicating with an outlet of the mixture tank and the other side having a through hole formed therein to allow a fluid including a cleaning solution and air to be introduced therethrough, wherein the impeller is rotatably installed within the housing and increases contact among air, a cleaning solution, and raw water to facilitate generation of bubbles.

3. The toilet cleaning apparatus of claim 2, wherein the bubble generation unit further includes ribs formed on at least one rotary blade of the impeller and an inner circumferential surface of the housing to increase contact between air and the fluid.

4. The toilet cleaning apparatus of claim 2, wherein the impeller is rotated by water pressure from raw water introduced to the mixture tank.

5. The toilet cleaning apparatus of claim 1, further comprising: a nozzle case in which one or more nozzles are movably provided to clean a portion of a human body, wherein the bubble discharge unit is provided in the nozzle case to discharge bubbles generated by the bubble generation unit to the nozzle for the cleaning thereof.

6. The toilet cleaning apparatus of claim 5, further comprising a cleaning member provided in the nozzle case and jetting washing water to the nozzle.

7. The toilet cleaning apparatus of claim 6, wherein the bubble discharge unit comprises:

a bubble inlet connected to an outlet of the mixture tank by a mixed solution flow channel; and a bubble outlet discharging bubbles introduced through the bubble inlet to the nozzle and the toilet bowl.

8. The toilet cleaning apparatus of claim 6, wherein the cleaning member comprises:

a washing water inlet allowing washing water to be introduced therethrough; and an injection hole provided to allow the washing water introduced through the washing water inlet to be jetted to the nozzle, wherein after the nozzle is cleaned by bubbles discharged from the bubble discharge unit, washing water is jetted to the nozzle to rinse the nozzle.

9. The toilet cleaning apparatus of claim 1, wherein the bubble discharge unit is connected to a rim outlet discharging washing water introduced through the raw water supply unit to the rim of the toilet and discharges bubbles through the rim outlet to cover water stored within the toilet.

10. The toilet cleaning apparatus of claim 9, further comprising a pressurization device installed between the raw water supply unit and the rim outlet to provide pressurization (or pressure) when washing water and bubbles are discharged.

11. The toilet cleaning apparatus of claim 1, wherein the bubble discharge unit comprises:

a main body installed in the toilet;

a bubble input member formed to penetrate the main body and connected to the mixture tank through a mixed solution flow channel to receive bubbles input thereto after being generated by the bubble generation unit; and a bubble output member formed to penetrate the main body and provided to communicate with the toilet bowl to discharge bubbles to the toilet bowl.

12. The toilet cleaning apparatus of claim 11, wherein the bubble discharge unit includes a porous filter provided within the main body and disposed between the bubble input member and the bubble output member.

13. The toilet cleaning apparatus of claim 1, wherein the cleaning solution supply unit comprises:

a cleaning solution storage container having a cleaning solution inlet and a cleaning solution outlet and having a cleaning solution storage space formed therein; and a metering pump connected to the cleaning solution storage container and supplying a pre-set quantity of the cleaning solution stored in the cleaning solution storage container to the mixture tank.

14. The toilet cleaning apparatus of claim 1, wherein the air supply unit is configured as an air pump generating air and supplying generated air to the mixture pump through an air flow channel.

15. A cleaning method of a toilet cleaning apparatus having a bubble supply mechanism, the method comprising:

a cleaning solution injecting operation of injecting a cleaning solution into a second inlet port of a mixture tank from a cleaning solution supply unit;

an air and raw water supplying operation of mixing raw water supplied from a raw water supply unit and air introduced from an air supply unit and supplying the same to a first inlet port of the mixture tank;

a bubble generating operation of generating bubbles with the raw water, air, and cleaning solution by using an impeller provided within the mixture tank; and a bubble discharging and toilet cleaning operation of discharging bubbles generated during the bubble generating operation to the toilet bowl from the mixture tank to clean the toilet bowl and cover water stored in the toilet, wherein the mixture tank comprises:

the first inlet port and the second inlet port;

an outlet having an entrance formed in a position higher than an entrance of the first inlet port and an entrance of the second input port and connected to the bubble discharge unit through a mixed solution flow channel; and a partition installed to extend downwardly from an inner upper surface between the outlet and the first and second inlet ports, wherein the bubble generating operation mixes the introduced raw water, cleaning solution, and air by the partition which forms a path along which the introduced raw water, cleaning solution, and air are discharged, and wherein the bubble discharging and toilet cleaning operation discharges bubbles to the toilet bowl from the outlet of the mixture tank.

16. The cleaning method of claim 15, wherein the bubble discharging and toilet cleaning operation comprises:

an operation of providing bubbles generated in the mixture tank to a rim of the toilet; and an operation of providing washing water introduced from the raw water supply unit to the rim of the toilet and discharging bubbles to a rim outlet communicating with the toilet bowl by flowing washing water.

17. The cleaning method of claim 16, wherein the operation of discharging bubbles to the rim outlet comprises:

a pressurization device driving operation of driving a pressurization device installed between the raw water supply unit and the rim outlet to provide pressurization when washing water and bubbles are discharged.

18. The cleaning method of claim 15, wherein the bubble discharging and toilet cleaning operation comprises:

discharging bubbles generated in the mixture tank to the nozzle provided in the nozzle case in order to clean the nozzle and the toilet with bubbles; and a nozzle cleaning operation of jetting washing water introduced from the raw water supply unit to the nozzle for the cleaning thereof.

* * * * *